US008789866B2

(12) United States Patent
Spanos et al.

(10) Patent No.: US 8,789,866 B2
(45) Date of Patent: Jul. 29, 2014

(54) SYSTEM AND METHOD FOR SUPPORTING A SHAFT INSIDE A TURBINE

(75) Inventors: Charles V. Spanos, Greenville, SC (US); John William Herbold, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 412 days.

(21) Appl. No.: 13/191,744

(22) Filed: Jul. 27, 2011

(65) Prior Publication Data

US 2013/0028699 A1 Jan. 31, 2013

(51) Int. Cl.
*B66C 1/10* (2006.01)
*B66C 1/62* (2006.01)
*F01D 25/28* (2006.01)

(52) U.S. Cl.
CPC ..... *F01D 25/285* (2013.01); *F05D 2230/68* (2013.01)
USPC ..... 294/67.5; 294/67.1; 294/81.3

(58) Field of Classification Search
USPC ..... 294/67.5, 81.3, 67.1, 67.21, 81.4, 294/119.2; 414/12; 415/17
See application file for complete search history.

(56) References Cited

U.S. PATENT DOCUMENTS 2,246,142 A * 6/1941 Moore ..... 294/67.21
3,253,851 A * 5/1966 Gilbert ..... 294/119.2
3,433,459 A * 3/1969 Logan ..... 254/281
3,596,968 A * 8/1971 Holm ..... 294/81.3
3,675,961 A * 7/1972 Wheeler ..... 294/67.1
3,762,755 A * 10/1973 Saether ..... 294/67.21
3,847,429 A * 11/1974 Pim ..... 294/67.21
4,017,109 A * 4/1977 Belinsky ..... 294/67.21
4,251,098 A * 2/1981 Belinsky ..... 294/67.21
4,433,830 A * 2/1984 Campbell ..... 254/264
5,800,000 A * 9/1998 Shockley ..... 294/81.3
6,048,012 A 4/2000 Selby et al.
6,113,348 A * 9/2000 Barozzi ..... 415/17
7,017,963 B1 3/2006 Setzke et al.
7,396,058 B2 * 7/2008 Mariani ..... 294/67.5
8,000,835 B2 * 8/2011 Friz et al. ..... 700/230
8,317,244 B1 * 11/2012 Schuyleman ..... 294/67.5
2013/0185926 A1 * 7/2013 Williams et al. ..... 29/559

* cited by examiner

*Primary Examiner* — Paul T Chin
(74) *Attorney, Agent, or Firm* — Dority & Manning, PA

(57) ABSTRACT

A system for supporting a shaft inside a turbine includes a support member having load and counterweight portions. A fulcrum is between the load and counterweight portions, and the load portion is configured to fit inside the turbine. Nests are connected to the support member between the load and counterweight portions, and the nests are configured to rigidly connect the shaft to the support member. A counterweight is connected to move along the support member only on the counterweight portion of the support member. A method for supporting a shaft inside a turbine includes inserting a support member inside the turbine and connecting the shaft to the support member. The method further includes connecting a crane to a fulcrum on the support member, lifting the support member and shaft with the crane, and moving a counterweight on the support member to change a horizontal angle of the support member.

14 Claims, 4 Drawing Sheets

SYSTEM AND METHOD FOR SUPPORTING A SHAFT INSIDE A TURBINE

FIELD OF THE INVENTION

The present invention generally involves a system and method for supporting a shaft inside a turbine. In particular embodiments, the system and method may be used to install and/or remove the shaft from the turbine during maintenance and repairs.

BACKGROUND OF THE INVENTION

Turbines are known in the art for extracting energy from a fluid and converting the extracted energy into work. For example, a typical turbine includes alternating stages of stationary nozzles attached to an outer casing and rotating blades attached to a rotor. As a working fluid, such as steam, air, or combustion gases, flows through the turbine, the stationary nozzles redirect and accelerate the working fluid onto the subsequent stage of rotating blades to cause the rotating blades to turn the rotor. A shaft typically couples the rotor to a work piece so that rotation of the rotor turns the work piece. For example, the shaft may couple the rotor to a generator so that rotation of the rotor operates the generator to produce electricity.

The shaft typically extends through a tunnel that is itself located inside an exhaust frame that surrounds the turbine. Occasionally, sections of the shaft must be removed from the turbine to facilitate maintenance and/or repairs to the turbine or associated components. Sections of the shaft are delicately balanced and may weigh anywhere from several hundred to several thousand pounds, or more. In addition, access to the shaft is somewhat restricted by the surrounding tunnel and exhaust frame. As a result, removal and installation of the shaft presents a number of difficulties such as a confined space, pinch points, and awkward manual lifting of the shaft. In addition, no special tools exist to lift, support, and remove the shaft with the exhaust frame installed. As a result, the weight of the shaft implicates safety and health concerns to avoid personnel injuries and/or damage to the shaft or nearby equipment, and the time required to safely move the shaft implicates the duration of the outage associated with the maintenance and/or repairs.

Various systems and methods have been used to support the shaft during installation and removal of the shaft from the turbine. For example, the shaft may be manually supported by a sufficient number of workers until the shaft is clear of the exhaust frame and can be supported by chain falls and/or a crane. Although this method is relatively expedient, it may create unacceptable health or safety risks to the workers, may require partial or complete removal of the exhaust frame, and may not be possible for heavier shafts. Another technique is to construct a temporary track in the tunnel or exhaust frame to support the shaft. Although the track reduces the health and safety risks, the construction and subsequent removal of the track is itself time consuming and may extend the duration of the outage associated with the maintenance and/or repairs. Therefore, an improved system and method for supporting the shaft during installation and/or removal would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supporting a shaft inside a turbine. The system includes a support member having a load portion and a counterweight portion. A fulcrum on the support member is between the load portion and the counterweight portion, and the load portion is configured to fit inside the turbine. A plurality of nests are connected to the support member between the load portion and the counterweight portion, and the plurality of nests are configured to rigidly connect the shaft to the support member. A counterweight is connected to move along the support member only on the counterweight portion of the support member.

Another embodiment of the present invention is a system for supporting a shaft inside a turbine that includes a support member having a load portion and a counterweight portion. A fulcrum on the support member is between the load portion and the counterweight portion. A plurality of fasteners extend from the support member between the load portion and the counterweight portion and are configured to rigidly connect the shaft to the support member. The system further includes means for moving a counterweight only on the counterweight portion toward or away from the fulcrum.

The present invention may also include a method for supporting a shaft inside a turbine. The method includes inserting a support member at least partially inside the turbine and connecting the shaft to the support member. The method further includes connecting a crane to a fulcrum on the support member, lifting the support member and shaft with the crane, and moving a counterweight on the support member to change a horizontal angle of the support member.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
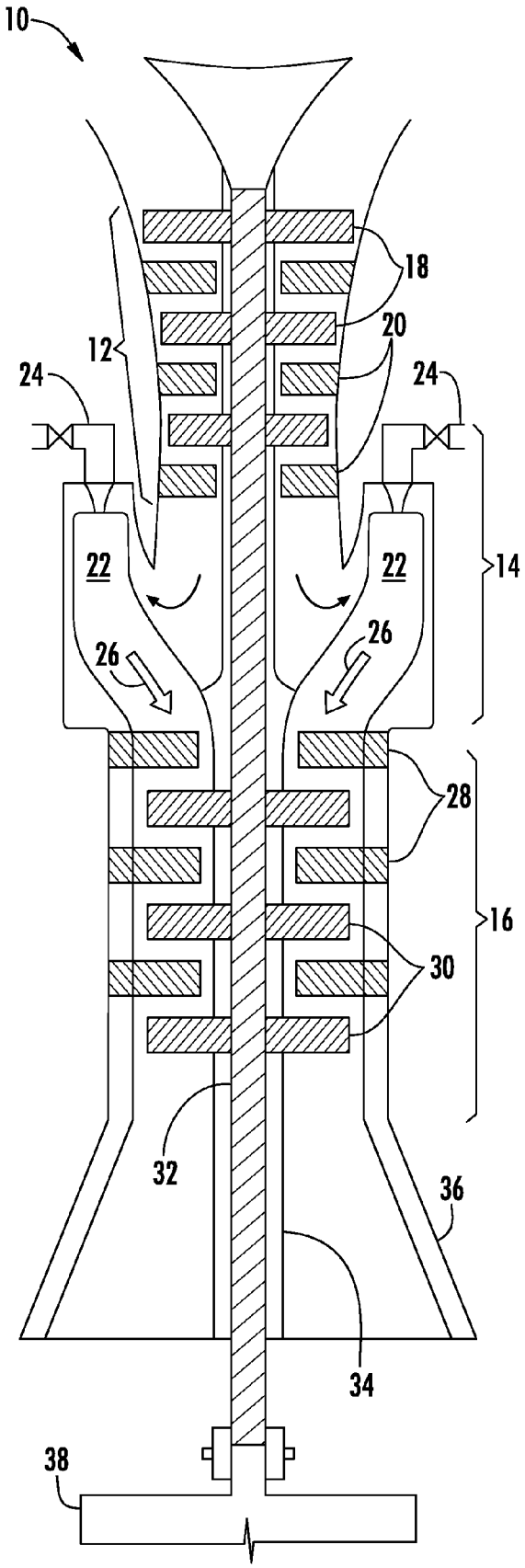
FIG. 1 is a simplified plan view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for supporting a shaft in a turbine. In particular embodiments, a support member may be inserted into the tunnel adjacent to the shaft and rigidly attached to the shaft. A counterweight may be used to balance the weight of the shaft on the support member as a crane attached to a fulcrum on the support member lifts the support member and attached shaft out of the turbine. The system and method thus reduces the health and safety risks as well as the time required to remove and/or install the shaft with respect to the turbine.

FIG. 1 is a simplified plan view of an exemplary gas turbine 10. As shown, the gas turbine 10 generally includes an axial compressor 12 at the front, one or more combustors 14 downstream from the compressor 12, and a turbine 16 downstream from the combustors 14. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A.

Ambient air may be supplied to the compressor 12, and rotating blades 18 and stationary vanes 20 in the compressor 12 progressively impart kinetic energy to the working fluid (air) to produce a compressed working fluid at a highly energized state. The compressed working fluid exits the compressor 12 and flows into a combustion chamber 22 in each combustor 14. A fuel supply 24 in fluid communication with each combustor 14 supplies a fuel to each combustion chamber 22, and the compressed working fluid mixes with the fuel and ignites to generate combustion gases having a high temperature and pressure. The combustion gases flow along a hot gas path 26 through the turbine 16 where they expand to produce work. Specifically, the combustion gases may flow across alternating stages of stationary nozzles 28 and rotating buckets 30 in the hot gas path 26 to rotate a shaft 32. As shown in FIG. 1, at least a portion of the shaft 32 may extend through a tunnel 34 inside and exhaust frame 36 of the turbine 16. In this manner, the shaft 32 may connect to a workpiece 38 outside of the turbine 16 to produce work.

Figure 2:
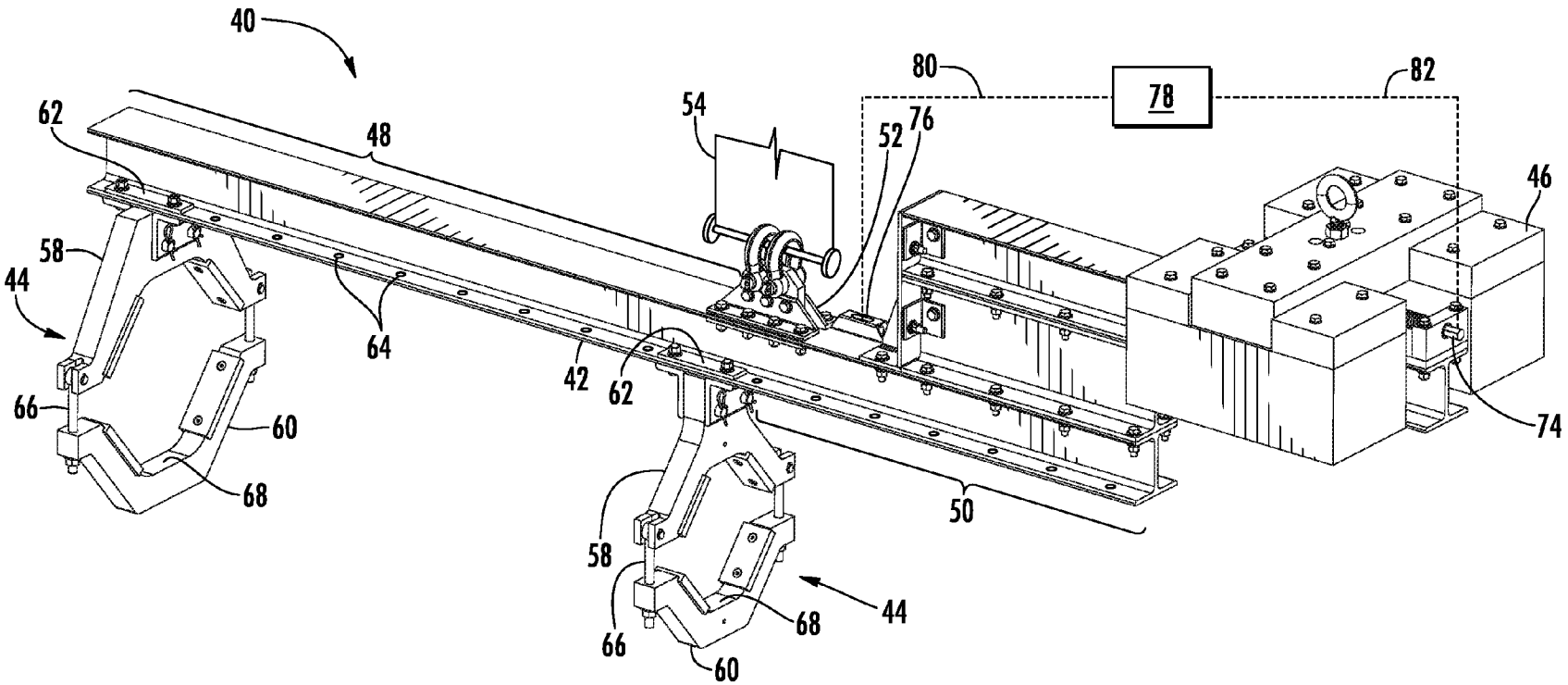
FIG. 2 is a perspective view of a system for supporting the shaft according to one embodiment of the present invention.
Figure 3:
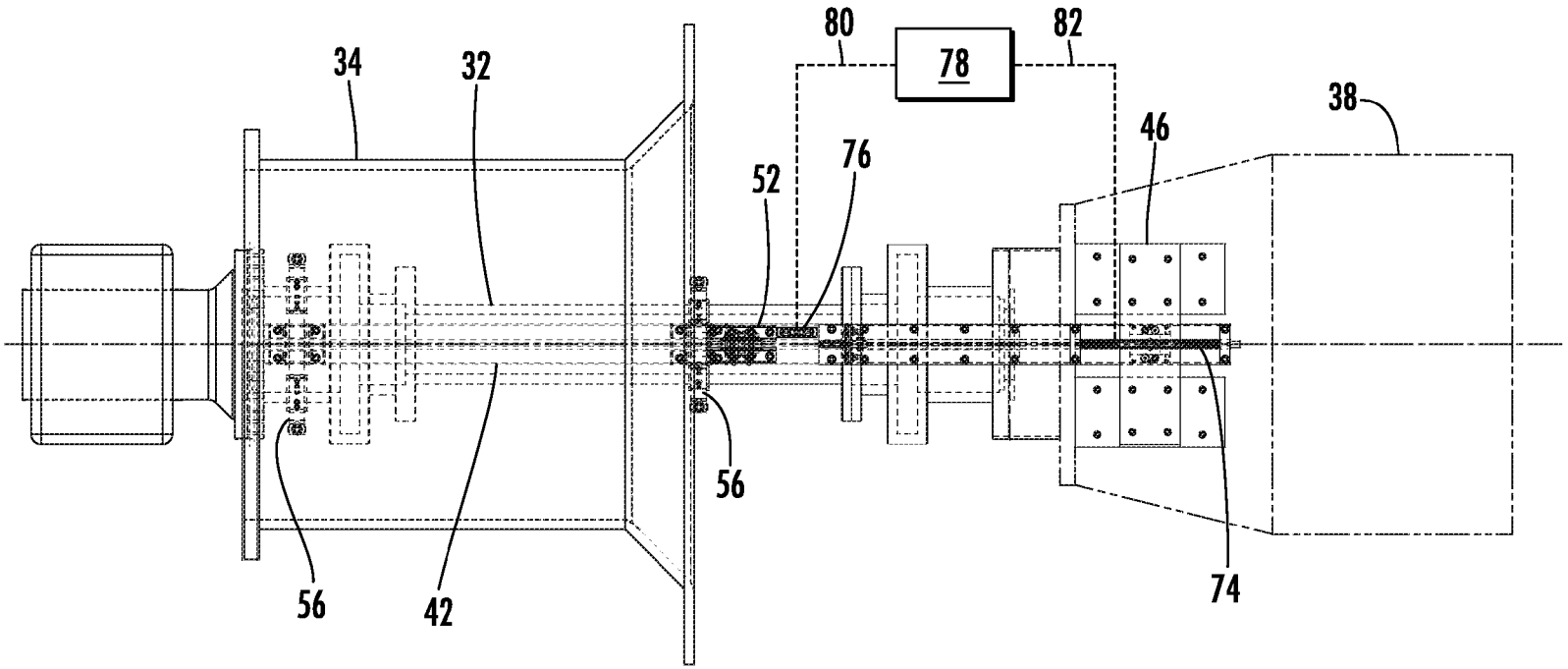
FIG. 3 is a top plan view of the system shown in FIG. 2 removing the shaft.
Figure 4:
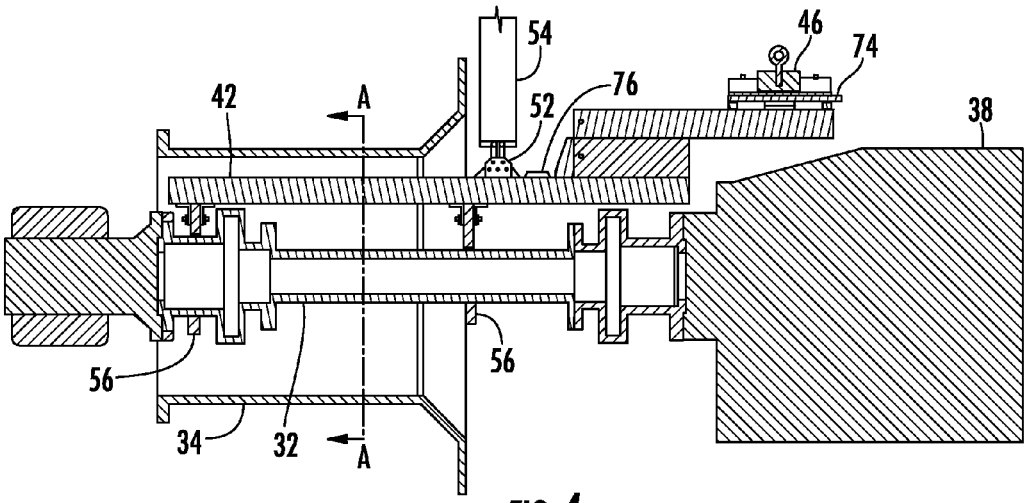
FIG. 4 is a side plan view of the system shown in FIG. 2 removing the shaft.
Figure 5:
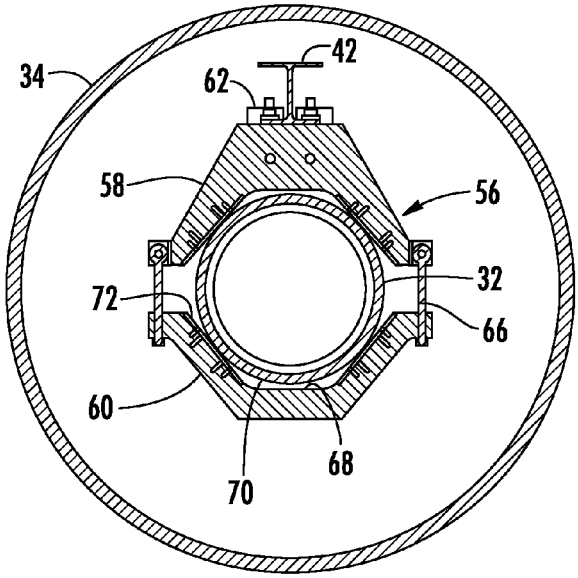
FIG. 5 is an axial cross-section view of the system shown in FIG. 4 taken along line A-A rigidly connected to the shaft.

FIGS. 2-4 provide perspective, top, and side views, respectively, of a system 40 for supporting the shaft 32 according to one embodiment of the present invention, and FIG. 5 provides an axial cross-section view of the system 40 shown in FIG. 4 taken along line A-A rigidly connected to the shaft 32. In particular embodiments, the system 40 may comprise a support member 42, a plurality of nests 44, and a counterweight 46. The support member 42 may comprise any suitable structure for supporting the combined weight of the shaft 32, nests 42, and counterweight 46, if present. For example, the support member 42 may comprise an I-beam, a reinforced bar, or another suitable structure known to one of ordinary skill in the art. The support member 42 is generally divided into a load portion 48 and a counterweight portion 50 separated by a fulcrum 52 between the load portion 48 and the counterweight portion 50. The support member 42 may be symmetric or asymmetric between the load portion 48 and the counterweight portion 50. In any event, the load portion 48 is configured or sized to fit or extend inside the turbine 16, exhaust frame 36, and/or the tunnel 34, depending on the particular embodiment. In this manner, the load portion 48 of the support member 42 may be inserted inside the turbine 16, exhaust frame 36, and/or tunnel 34, and a crane 54 may be connected to the fulcrum 52 to lift the system 40 as desired. The crane 54 may comprise any suitable device rated to lift the combined weight of the system 40 and shaft 32. For example, the crane 54 may comprise a stationary crane, a portable crane, or an overhead crane, as shown in FIGS. 2 and 4.

The plurality of nests 44 may be connected to the support member 42 at desired positions between the load portion 48 and the counterweight portion 50 to rigidly connect the shaft 32 to the support member 42. The nests 44 may comprise, for example, clamps, ropes, cords, brackets, and/or fasteners 56, as shown most clearly in FIGS. 2 and 5. The fasteners 56 may extend downward from the support member 42 to rigidly connect the shaft 32 to the support member 42. For example, as shown most clearly in FIGS. 2 and 5, each fastener 56 may comprise a first portion or an upper section 58 releasably connected to a second portion or a lower section 60.

The upper section 58 may be fixedly connected to the support member 42, such as by bolting a flange 62 of the upper section 58 to the support member 42. In particular embodiments, the upper section 58 of one or more fasteners 56 may be slidingly connected to the support member 42 so that the position of one or more fasteners 56 may be adjusted between the load portion 48 and the counterweight portion 50, depending on the particular dimensions, shape, and length of the shaft 32. For example, as shown most clearly in FIG. 2, the support member 42 may include a plurality of bolt holes 64 that allow the flange 62 of the upper section 58 to slide along the support member 42 before being bolted in the desired position.

The lower section 60 is opposed to the upper section 58 and may releasably connect to the upper section 58 using, for example, bolts, clamps, or turnbuckles 66 as shown in FIGS. 2 and 5. When the upper and lower sections 58, 60 are connected to one another, they may define an internal surface 68 that substantially conforms to an external surface 70 of the shaft 32 to rigidly connect the shaft 32 to the support member 42. For example, the internal surface 68 of the fastener 56 may be circular to more precisely conform to the external surface 70 of the shaft 32. Alternately, as shown in FIGS. 2 and 5, the internal surface 68 may be polygonal to substantially conform to shafts 32 having a varying and/or non-circular external surface 70. In particular embodiments, the nests 44 or fasteners 56 may further include one or more pads 72 or similar shock absorbing material to further support and cushion the shaft 32 when connected to the support member 42.

As shown most clearly in FIGS. 2 and 4, the counterweight 46 may be connected to the support member 42 and configured to move along the support member 42 only on the counterweight portion 50 of the support member 42 to balance the weight of the shaft 32 across the fulcrum 52. For example, the system 40 may include means for moving the counterweight 46 along the counterweight portion 50 of the support member 42 toward or away from the fulcrum 52. The means for moving the counterweight 46 may comprise any suitable mechanism for moving one object with respect to another. For example, the means for moving the counterweight 46 may comprise a pneumatic piston, a hydraulic piston, a gear, a ratchet and pawl, or other mechanical or servo-mechanical device known to one of ordinary skill in the art. In the particular embodiment shown in FIGS. 2-4, the means for moving the counterweight 46 comprises a bolt 74 in threaded engagement with the support member 42. A wrench, drill, or other suitable tool may be applied to the bolt 74 to rotate the bolt 74 clockwise or counterclockwise to alternately move the counterweight toward or away from the fulcrum 52 on the counterweight portion 50 of the support member 42.

The precise position of the counterweight 46 on the counterweight portion 50 of the support member 42 required to balance the weight of the shaft 32 across the fulcrum 52 may be determined by calculations factoring in the weight of the shaft 32, the weight of the counterweight 46, and the moment arms of the load and counterweight portions 48, 50. In particular embodiments, the system 40 may include a sensor 76 connected to the support member 42 to measure or determine a horizontal angle of the support member 42. The sensor 76 may comprise any suitable instrument for detecting and measuring the horizontal attitude of the support member 42. For example, as shown most clearly in FIGS. 2 and 3, the sensor 76 may comprise a level containing a viscous fluid that readily indicates the horizontal attitude of the support member 42. In this manner, as the nests 44 rigidly connect the shaft 32 to the support member 42, the sensor 76 will indicate any change in the horizontal attitude of the support member 42, and the position of the counterweight 46 on the counterweight portion 50 of the support member 42 may be adjusted to achieve a desired horizontal attitude of the support member 42 to facilitate movement of the shaft 32 into or out of the turbine 16, exhaust frame 36, and/or tunnel 34.

In particular embodiments, the system 40 may further include a controller 78 connected to the sensor 76 and the means for moving the counterweight 46. The technical effect of the controller 78 is to receive an attitude signal 80 from the sensor 76 and generate a control signal 82 to the means for moving the counterweight 46 to move the counterweight 46 on the support member 42 to position the support member 42 at a predetermined horizontal angle or attitude. As used herein, the controller 78 may comprise any combination of microprocessors, circuitry, or other programmed logic circuit and is not limited to any particular hardware architecture or configuration. Embodiments of the systems and methods set forth herein may be implemented by one or more general-purpose or customized controllers 78 adapted in any suitable manner to provide the desired functionality. The controller 78 may be adapted to provide additional functionality, either complementary or unrelated to the present subject matter. For instance, one or more controllers 78 may be adapted to provide the described functionality by accessing software instructions rendered in a computer-readable form. When software is used, any suitable programming, scripting, or other type of language or combinations of languages may be used to implement the teachings contained herein. However, software need not be used exclusively, or at all. For example, as will be understood by those of ordinary skill in the art without required additional detailed discussion, some embodiments of the systems and methods set forth and disclosed herein may also be implemented by hard-wired logic or other circuitry, including, but not limited to application-specific circuits. Of course, various combinations of computer-executed software and hard-wired logic or other circuitry may be suitable, as well.

The system 40 described and illustrated with respect to FIGS. 2-5 may thus provide a method for supporting the shaft 32 inside the turbine 16. The method generally includes inserting the support member 42 at least partially inside the turbine 16, positioning the nests 44 on the support member 42 to correspond to a predetermined position on the shaft 32, and connecting the shaft 32 to the support member. The shaft 32 may then be supported by the system 40 and disconnected from the turbine 16 and workpiece 38. The crane 54 may be connected to the fulcrum 48 to lift the support member 42 and shaft 32, and the counterweight 46 may be moved on the support member 42 achieve a desired horizontal attitude of the support member 42 while moving the shaft 32. Depending on the particular embodiment, the method may further include measuring the horizontal angle of the support member 42 and adjusting the position of the counterweight 46 as the shaft 32 is moved inside the turbine 16. As a result, the method allows the shaft 32 to be safely, reliably, and efficiently supported as the shaft 32 is installed or removed from the turbine 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for supporting a shaft inside a turbine, comprising:

a. a support member, wherein said support member comprises a load portion and a counterweight portion;

b. a fulcrum on said support member between said load portion and said counterweight portion;

c. a plurality of nests connected to said support member between said load portion and said counterweight portion, wherein said plurality of nests are configured to rigidly connect the shaft to said support member;

d. a counterweight connected to move along said support member only on said counterweight portion of said support member; and e. wherein at least one nest of said plurality of nests and at least a portion of said load portion of said support member are sized to fit within an exhaust duct of the turbine.

2. The system as in claim 1, wherein each nest comprises a clamp having a first portion fixedly attached to said support member and a second portion opposed to said first portion.

3. The system as in claim 1, wherein each nest comprises an internal surface that substantially conforms to an external surface of the shaft.

4. The system as in claim 1, where at least one nest is slidingly connected to said support member.

5. The system as in claim 1, further comprising means for moving said counterweight along said counterweight portion of said support member.

6. The system as in claim 1, further comprising a crane connected to said fulcrum.

7. The system as in claim 1, further comprising a sensor connected to said support member, wherein said sensor determines a horizontal angle of said support member.

8. The system as in claim 1, further comprising a controller configured to move said counterweight on said support member to position said support member at a predetermined horizontal angle.

9. A system for supporting a shaft inside an exhaust duct of a turbine, comprising:

a. a support member, wherein said support member comprises a load portion and a counterweight portion;

b. a fulcrum on said support member between said load portion and said counterweight portion;

c. a plurality of fasteners extending from said support member between said load portion and said counterweight portion, wherein said plurality of fasteners are configured to rigidly connect the shaft to said support member;

d. wherein at least a portion of said load portion of said support member is sized to fit radially between the shaft and the exhaust duct of the turbine; and e. means for moving a counterweight only on said counterweight portion toward or away from said fulcrum.

10. The system as in claim 9, wherein each fastener comprises an internal surface that substantially conforms to an external surface of the shaft.

11. The system as in claim 9, where at least one fastener is slidingly connected to said support member.

12. The system as in claim 9, further comprising a crane connected to said fulcrum.

13. The system as in claim 9, further comprising a sensor connected to said support member, Wherein said sensor determines a horizontal angle of said support member.

14. The system as in claim 9, further comprising a controller configured to move, the counterweight on said support member to position said support member at a predetermined horizontal angle.

* * * * *

UNITED STATES PATENT AND TRADEMARK OFFICE

CERTIFICATE OF CORRECTION

PATENT NO. : 8,789,866 B2
APPLICATION NO. : 13/191744
DATED : July 29, 2014
INVENTOR(S) : Spanos et al.

It is certified that error appears in the above-identified patent and that said Letters Patent is hereby corrected as shown below:

In the Specification

In Column 3, Lines 52-53, delete "nests 42," and insert -- nests 44, --, therefor.

In Column 5, Line 62, delete "fulcrum 48" and insert -- fulcrum 52 --, therefor.

In the Claims

In Column 7, Line 14, in Claim 13, delete "Wherein" and insert -- wherein --, therefor.

In Column 7, Line 17, in Claim 14, delete "move," and insert -- move --, therefor.

Signed and Sealed this
Twenty-sixth Day of May, 2015

Michelle K. Lee

Michelle K. Lee
*Director of the United States Patent and Trademark Office*